US006154886A

United States Patent [19]

Hottner

[11] Patent Number: 6,154,886

[45] Date of Patent: Dec. 5, 2000

[54] GLOVE INSERT

[76] Inventor: Martin Hottner, Sperberstr.31,83052, Bruckmühl, Germany

[21] Appl. No.: 09/335,337

[22] Filed: Jun. 17, 1999

[30] Foreign Application Priority Data

Jul. 16, 1998 [EP] European Pat. Off. ..... 98113247

[51] Int. Cl.[7] ..... A41D 19/00

[52] U.S. Cl. ..... 2/169; 2/167

[58] Field of Search ..... 2/159, 161.2, 161.6, 2/162, 163, 167, 169, 170

[56] References Cited

U.S. PATENT DOCUMENTS

| | | | |
|---|---|---|---|
| 2,125,673 | 8/1938 | Geissmann | 2/159 |
| 3,251,067 | 5/1966 | Shmikler | 2/169 |
| 4,021,640 | 5/1977 | Gross et al. | 219/211 |
| 4,032,990 | 7/1977 | Mandiman | 2/161 |
| 4,643,791 | 2/1987 | Jurrius et al. | 156/251 |
| 5,568,656 | 10/1996 | Kim | 2/164 |
| 5,603,119 | 2/1997 | Rinehart | 2/169 |
| 5,728,255 | 3/1998 | Karam et al. | 156/367 |

*Primary Examiner*—John J. Calvert
*Assistant Examiner*—Katherine Moran
*Attorney, Agent, or Firm*—Carol A. Lewis White

[57] ABSTRACT

The invention relates to a glove insert (10) which is made of a first textile piece (20) and second textile piece (30) and has a finger portion (40) having a finger radial side (44) and a finger ulnar side (46), a thumb portion (50) with a thumb tip (60) and a finger-side thumb outer edge (55), a palm portion (70), a cuff portion (80) with an ulnar side cuff outer edge (85) on the ulnar side of the glove insert (10) and a radial side cuff outer edge (86) on the radial side of the glove insert (10), a hand entry (90) through which the wearer slips a hand, and a crotch (100) being between the finger radial side (44) and the thumb portion (60). The first textile piece (20) is joined to the second textile piece (30) by a first seam (110) situated on the cuff ulnar side outer edge (85), the finger radial-side outer edge (44) and the finger-side thumb outer edge (55) and running from the thumb tip (60) across the palm portion (70) and cuff portion (89) towards the cuff ulnar side outer edge (85).

30 Claims, 10 Drawing Sheets

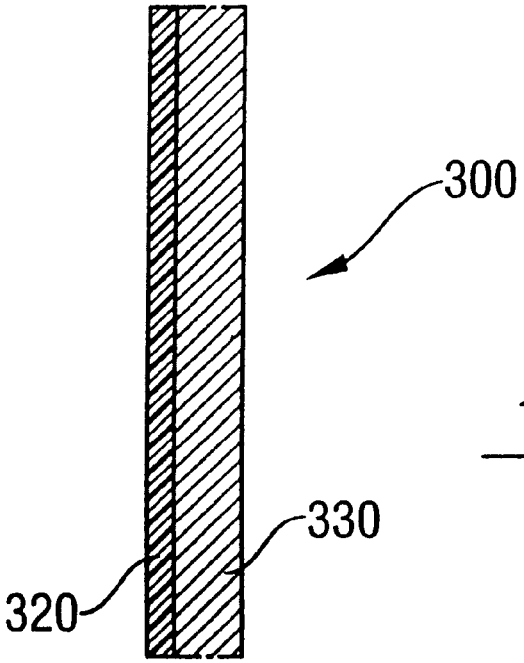
Fig. 6a
Fig. 6b
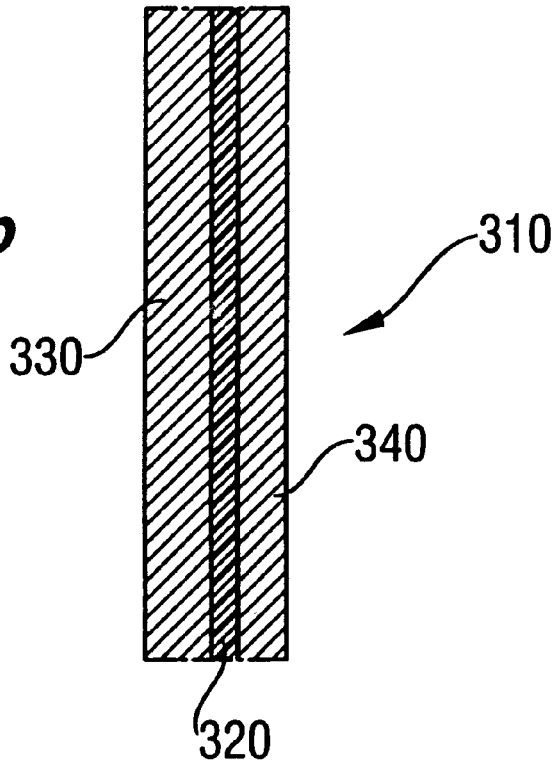

GLOVE INSERT

FIELD OF THE INVENTION

The invention relates to a glove insert for insertion into an outer shell.

BACKGROUND OF THE INVENTION

There are currently a number of gloves on the market employing waterproof liners or inserts 10 in an outer glove shell 15 such as shown in FIG. 5. Glove inserts of this type are supplied by W.L. Gore & Associates, Feldkirchen, Germany under the trade name DIRECT GRIP®. Their manufacture is described in German Patent DE-C-38 19 362 (Kleis) assigned to W.L. Gore & Associates. The glove insert taught in this patent is made of a microporous polymer which is both waterproof and water vapour permeable ("breathable"), i.e. it allows the passage of water vapour in the form of sweat. Preferably the glove insert in the prior art patent is made of expanded polytetrafluoroethylene. The glove pattern used in this construction is known as the Flat Pattern and incorporates a palm and a dorsal panel of the same size. Whilst such constructions are easy and therefore less costly to manufacture, they do not take into account that the fingers of a wearer's hand and the thumb move in different planes. As is pointed out in U.S. Pat. No. 5,560,044 (Masely) assigned to W.L. Gore & Associates, the excess liner material in a Flat Pattern liner gathers in horizontal folds in the palm and dorsal region of the wearer's hand which can result in discomfort and frustration to the user. U.S. '044 solved this problem by providing a tape on an exterior surface of the insert to "gather up" the excess material by forming a fold in the glove insert.

Another approach to solving this problem is taught in U.S. Pat. No. 5,568,656 (Kim) in which a separate thumb portion is attached to the palm panel of a glove insert. The thumb portion is attached to the glove insert first of all by stitching and then taping the stitch holes.

A further method for making a glove insert is taught in U.S. Pat. No. 4,643,791 (Jurrius et al.) in which a pair of thermoplastic sheets are joined together at their peripheral edges and at a seam running from the crotch between the finger and the thumb down diagonally across the palm of the hand to the hand entry. In this manner a glove insert is formed in which the thumb is formed in a different plane than the fingers.

SUMMARY OF THE INVENTION

It is an object of the invention to improve the comfort of a glove insert. It is an object of the invention to the wearer's thumb to move in a different plane than the fingers in a glove insert.

These and other objects of the invention are solved by providing a glove insert being made of a first textile piece and second textile piece and having a finger portion with a finger radial side and a finger ulnar side, a thumb portion with a thumb tip and a finger-side thumb outer edge, a palm portion, a cuff portion with an ulnar side cuff outer edge on the ulnar side of the glove insert and a radial side cuff outer edge on the radial side of the glove insert, a hand entry through which the wearer slips a hand, and a crotch being situated between the finger radial side and the thumb portion. The finger radial side is contiguous with the finger ulnar side, cuff ulnar-side outer edge and the finger-side thumb outer edge and the first textile piece is joined to the second textile piece solely by a first seam situated on the cuff ulnar side outer edge, the finger radial-side outer edge and the finger-side thumb outer edge and running from the thumb tip across the palm portion and cuff portion towards the cuff ulnar side outer edge. The presence of a seam running from the thumb tip across the palm portion and the cuff portion alows the use of a pattern with less material within the palm portion with the result that thumb portion of the glove insert is forced into a different plane than the fingers.

In one embodiment of the invention, the first textile piece furthermore includes a second seam running from the crotch to a second position in the cuff portion at the hand entry. The second seam is a further method of removing excess material from the palm portion to allow the construction of a comfortable gove insert. The first seam and the second seam are substantially parallel to each other and both run diagonally across the palm portion and the cuff portion of the glove insert.

In order to construct a waterproof glove, both the first seam and the second seam have to be constructed to be waterproof, i.e. withstand a water-entry pressure of at least 0.07 bar and preferably of at least 2.1 bar.

The first and second seams can be formed by an adhesive bond, by welding or by sewing or welding and then sealing by a seam sealing tape.

The glove insert as a whole is preferably waterproof such that it withstands a water-entry pressure of at least 0.07 bar and preferably at least 2.1 bar. For comfort purposes the glove insert is also "breathable", i.e. it allows the passage of water vapour in the form of sweat. This requires that the first textile piece and the second textile piece be at least partially water-vapour permeable. The resistance to moisture vapour transmission Ret of the first textile piece and the second textile piece is less than 150 $m^2$. Pa/W.

In one embodiment of the invention the glove insert is made from a first textile piece and a second textile piece which are formed of a textile laminate including a functional layer. Such functional layers include polyesters, polyamide, polyolefins including polyethylene and polypropylene, polyvinylchloride, polyketones, polysulfones, polycarbonates, fluoropolymers including polytetrafluoroethylene (PTFE), polyacrylates, polyurethanes, copolyetheresters, copolyetheramides. Most preferably the functional layer is expanded PTFE since this offers a low resistance to water vapour transmission and is highly waterproof. The functional layer may be coated with a hydrophobic continuous polymer layer in order to improve the durability of the functional layer. Furthermore expanded PTFE can be laminated with a hand-side textile layer and an outer textile layer to provide a mechanically stable and damage resistant glove insert. Furthermore pile or fleece textile layers could be used to obtain a thermal insulating layer. The glove insert of the invention has either four individual finger elements, two individual finger elements as a lobster pattern, or the glove insert is a mit. The glove insert is affixed into an outer shell which further protects the glove insert from damage and which also serves aethetic purposes.

DESCRIPTION OF THE DRAWINGS

FIG. 6 show the structure of a two-layer and a three-layer laminate.

DEFINITIONS

Waterproof

Figure 1:
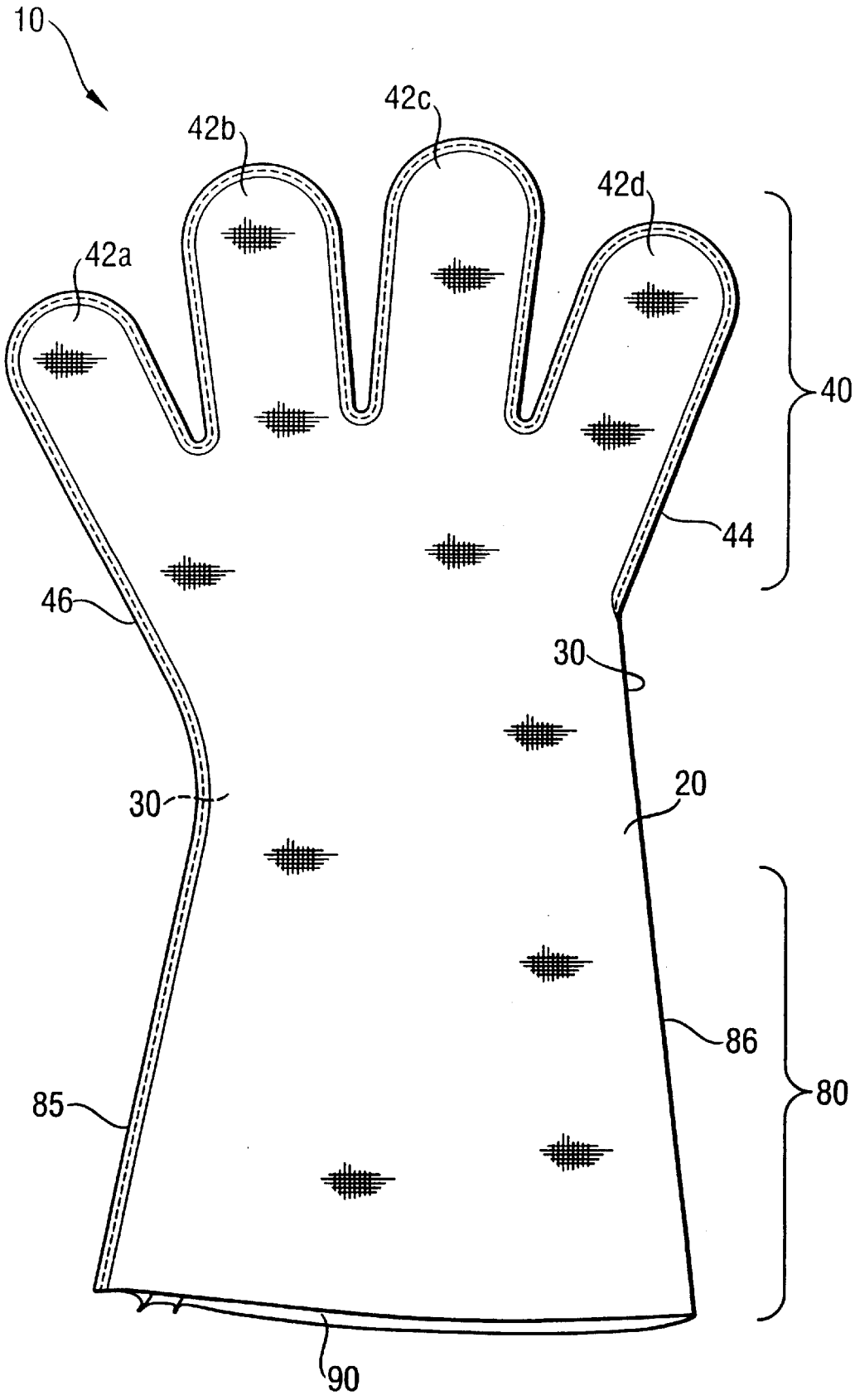
FIG. 1 shows a back (dorsal) view of the glove insert of the invention.

Waterproof as used herein is meant having water-penetration-resistance (hydrostatic resistance) of 0.07 bar or more. This measurement is carried out using by placing a test sample with an area of 100 $cm^2$ under increasing water pressure. For this purpose, distilled water with a temperature of 20±2° C. is used and the rate of increase of the water pressure was 60±3 $cmH_2O$/min. The outer surface of the material is watched carefully for the appearance of any water forced through the material. Water seen on the surface is interpreted as a leak. The water penetration resistance of the sample is then the pressure at which water appears on the opposite side of the sample. The exact method of carrying out this test is given in the ISO Standard No. 811 from 1981.

Waterproof as used herein for the glove insert is meant having textile laminates with a water penetration resistance of 0.07 bar or more and whose seams have a penetration resistance of 0.07 bar or more. The waterproofness of the glove insert can be measured using the "Whole Glove Leak Tester" apparatus disclosed in U.S. Pat. No. 4,776,209 (Patchell) assigned to W.L. Gore & Associates, Inc., in which air at pressure of between 0.07 bar and 0.35 bar is admitted into the inside of a glove insert disposed in a water tank.

Water Vapour Permeable

Water vapour permeable as used herein is meant having a resistance to water-vapour-transmission (RET) of under 150 ($m^2$·Pa)/W.

One test that can be used to measure the water vapour transmission rate the Hohenstein MDM Dry Method which is explained in the Standard-Prüfvorschrift (Standard Test Rules) No. BPI 1.4 dated September 1987 and issued by the Bekleidungsphysiologisches Instituts e.V. Hohenstein, Germany.

A further test which can be used to determine the water-vapour transmission rate (WVTR) is given below. The procedure has been found to be suitable for testing fabric laminates with high transmission rates.

In this procedure, approximately 70 $mm^3$ of a saturated salt solution of potassium acetate and distilled water was placed into a 133 $mm^3$ polypropylene cup having an inside diameter of 6.5 cm at the mouth. An expanded PTFE membrane, having a Gurley number of about 7 seconds, a bubble point of about 179 kPa, a thickness of about 37 $\mu$m and a weight of about 20 g/$m^2$, available from W.L. Gore & Associates, Putzbrunn, Germany, was heat sealed to the lip of the cup to create a taut, leakproof, microporous barrier containing the salt solution. A similar expanded PTFE membrane was mounted taut on the surface of a water bath while ensuring that the membrane is in contact with the water in the bath. The water bath assembly was controlled at 23±2° C. utilising a temperature controlled room and a water circulating bath.

The area for testing WVTR was 7.5 cm diameter and the sample was equilibrated in a chamber having a relative humidity of about 50% for a minimum of 4 hours. The sample was then placed on the surface of the expanded PTFE membrane covering the water bath. The cup assembly was weighed to the nearest milligram and was placed in an inverted manner onto the centre of the test sample. Water transport was provided by the driving force between the bath water and the saturated salt solution providing water flux by diffusion in that direction. The sample was tested for 15 minutes and the cup assembly was then removed, weighed again to with a milligram. The WVTR of the sample was calculated from the weight gain of the cup assembly and was expressed in grams of water per square meter of sample surface area per 24 hours.

Tables are available for the conversion of data between the WVTR and the RET.

Functional Layer

The term functional layer is used to denote a layer which had the properties that it is both waterproof and water-vapour permeable.

DETAILED DESCRIPTION OF THE INVENTION

Figure 2:
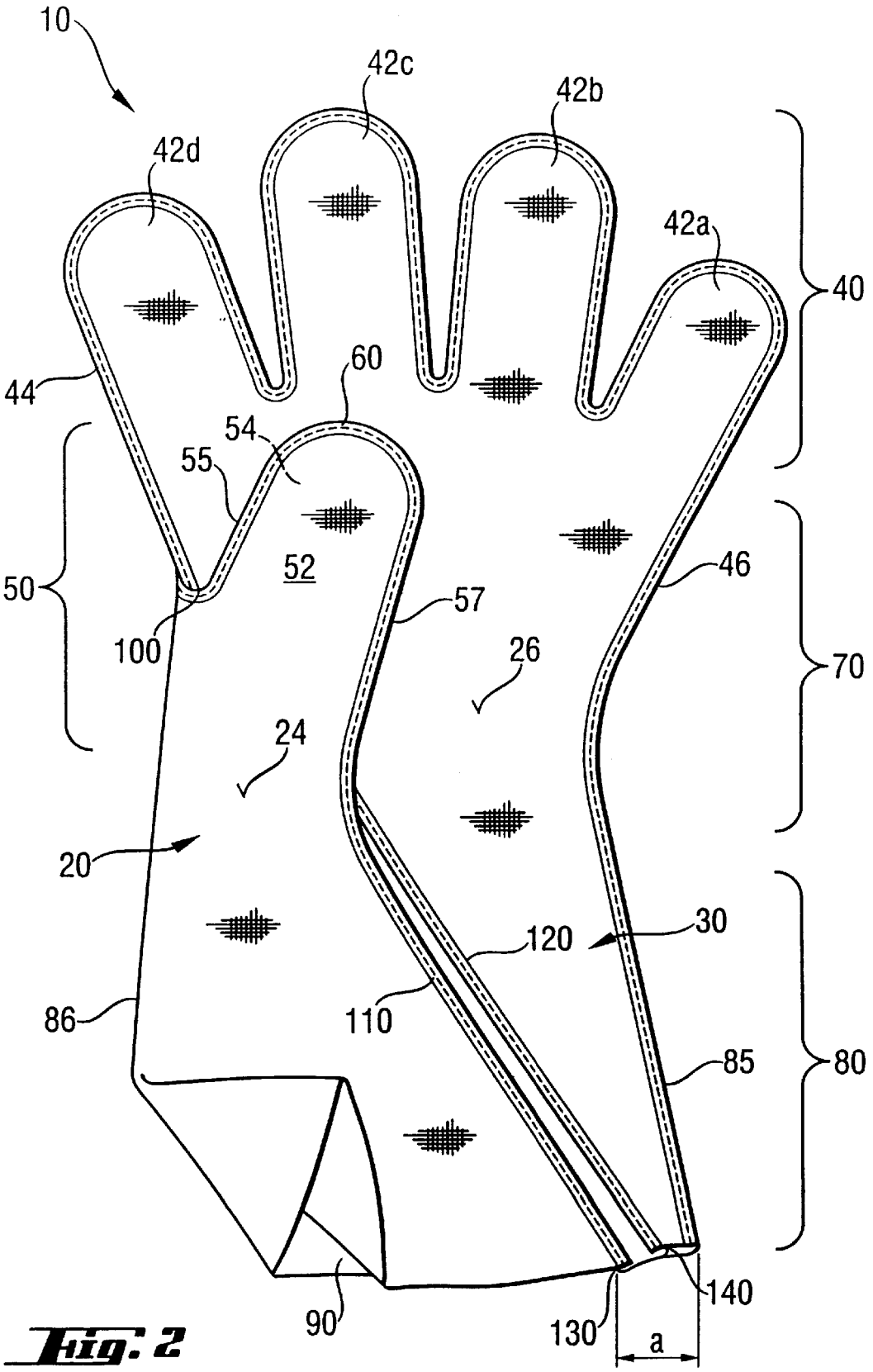
FIG. 2 shows a front (palm) view of the glove insert of the invention.

FIGS. 1 and 2 show a back or dorsal view and a front or palm view respectively of a glove insert 10 of the invention. The glove insert 10 has a finger portion 40 enclosing the fingers of the wearer, a thumb portion 50 enclosing the thumb of the wearer, a palm portion 70 covering the palm of the wearer, a cuff portion 80 enclosing the wrist of the wearer and a hand entry 90 through which the wearer slips his or her hand into the glove insert 10. The finger portion 40 is shown in these figures as having four separate coverings (42*a*–42*d*) for the fingers. It could equally well be in the form of a mitt or a lobster pattern (two separate finger coverings) without detracting from the principle of the invention.

The glove insert 10 is formed from a first textile piece 20 and a second textile piece 30. The first textile piece 20 forms the dorsal or back side of the glove insert and a first palm portion 24 of the palm or front side of the glove insert 10 as well as a first thumb side 52 of the thumb portion 50. The second textile piece 30 forms the front side of the finger portion 40, a second thumb side 54 of the thumb portion 50 as well as a second palm portion 26 of the front side of the glove insert 10. A palm portion 70 of the glove insert is thus formed from the first palm portion 24 of the first textile piece 20 and the second palm portion 26 of the second textile piece 30 which are connected together as will be described later with reference to the further figures.

The thumb portion 50 of the glove insert 10 has a thumb tip 60, a finger-side thumb outer edge 55 on the side of the thumb portion adjacent to the finger portion and a radial-side thumb outer edge 57 on the radial side of the glove insert 10. The thumb portion 50 is formed from the first thumb side 52 of the first textile piece 20 and the second thumb side 54 of the second textile piece 30.

The finger portion 40 has a finger radial side 44 on the radial side of the glove insert 10 and a finger ulnar side 46 on the ulnar side of the glove insert 10. A crotch 100 is situated between the thumb portion 50 and the finger portion 40. The crotch 100 is thus situated at the position at which the finger radial side 44 meets the finger-side thumb outer edge 55.

The cuff portion 80 of the glove insert 10 is adjacent to the hand entry 90 of the glove insert 10 and has an ulnar-side cuff outer edge 85 on the ulnar side of the glove insert 10.

Figure 3A:
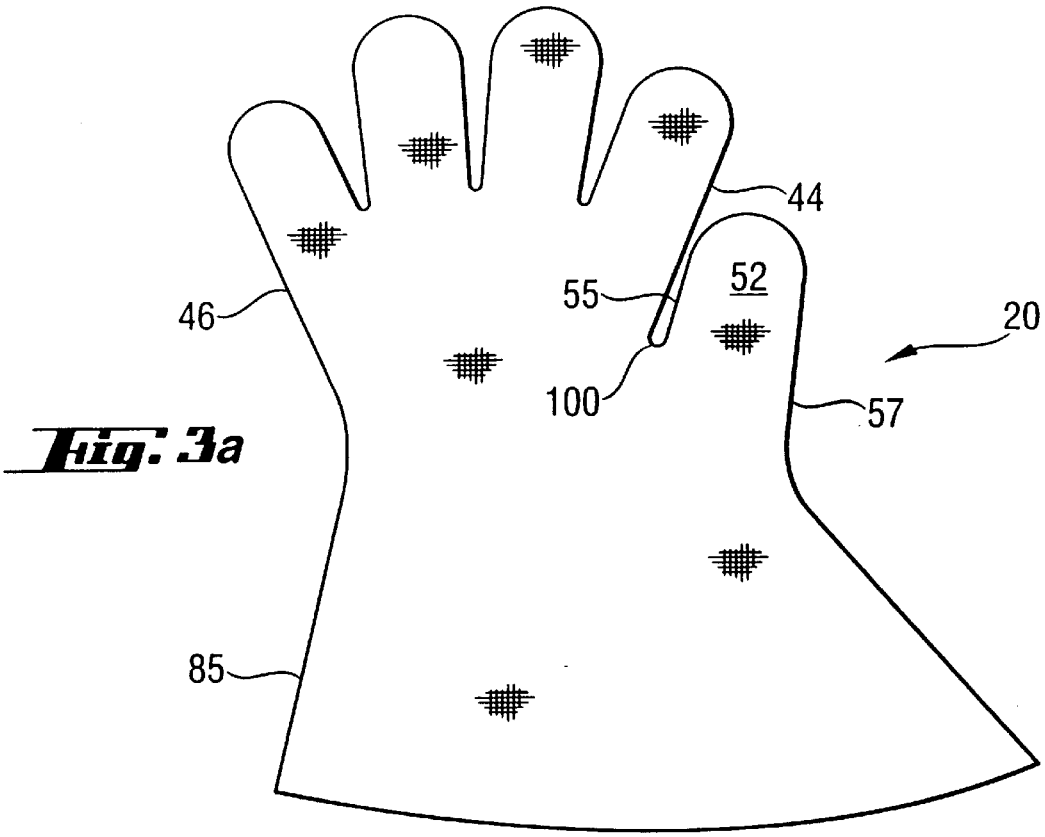
FIG. 3*a* shows the textile piece forming the dorsal side of the glove insert.
Figure 3B:
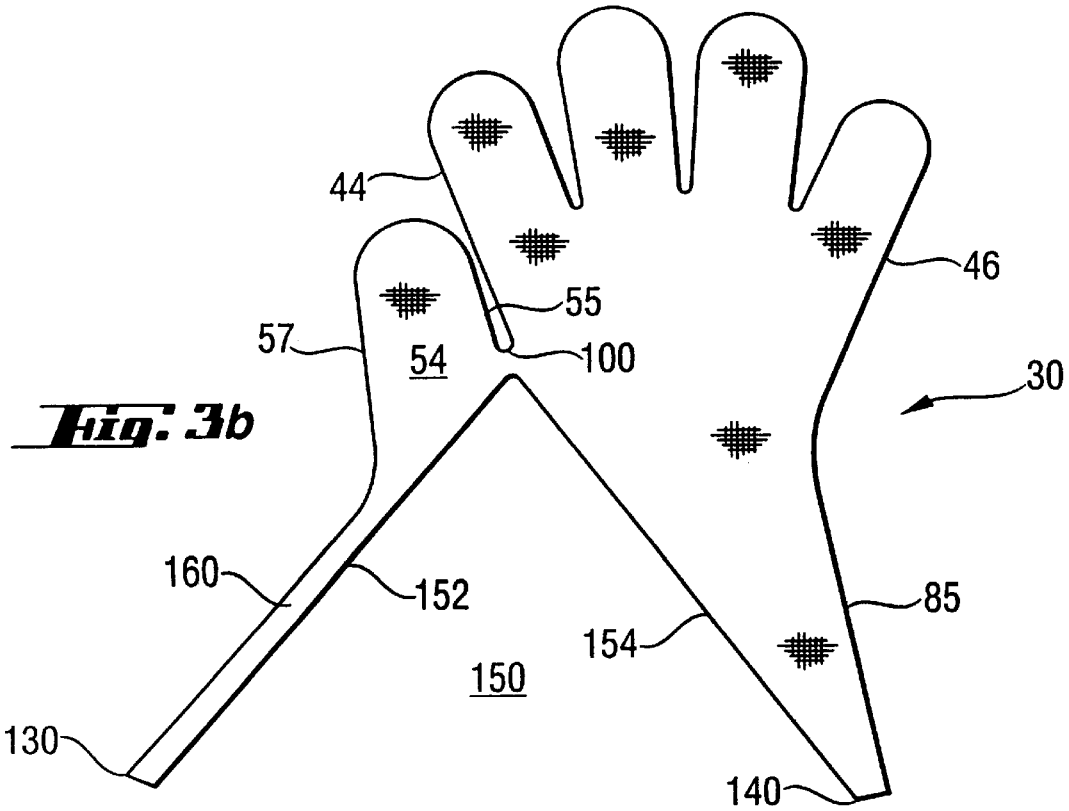
FIG. 3*b* shows the textile piece forming the palm side of the glove insert.

FIGS. 3*a* and 3*b* show the shape and structure of the first textile pieces 20 and the second textile piece 30 respectively prior to joining the two textile pieces 20, 30 together. The textile pieces 20 and 30 are preferably made from a textile laminate. The textile laminate may be in the form of a two-layer laminate 300 as shown in FIG. 6*a* or in the form of a three-layer laminate as shown in FIG. 6*b*. Both the two layer laminate 300 and the three layer laminate 310 incorporate a waterproof and water vapour permeable functional layer 320 in the form of a porous polymeric layer preferably coated with a continuous water vapour permeable layer. The porous polymeric layer used in this invention is a microporous polymer membrane having a microscopic structure of open, interconnecting micro voids. It exhibits air permeability and as such imparts, or does not impair, water vapour permeability. The microporous membrane used is typically of a thickness of 5 $\mu$m to 125 $\mu$m, most preferably of the order of about 5 $\mu$m to 25 $\mu$m. The useful polymers of the microporous membrane material include plastic polymers as well as elastomeric polymers. Examples of suitable polymers include polyesters, polyamide, polyolefins including polypropylene and polyester, polyketones, polysulfones, polycarbonates, fluoropolymers, polyacrylates, polyurethanes, copolyetheresters, copolyetheramides and the like. The preferred polymers are plastic polymers.

The preferred microporous polymer membrane material is expanded microporous polytetrafluoroethylene (PTFE). These materials are characterised by a multiplicity of open, interconnecting microscopic voids, high void volume, high strength, soft, flexible, stable chemical properties, high water vapour transfer and a surface that exhibits good contamination control characteristics. U.S. Pat. No. 3,953,566 and U.S. Pat. No. 4,187,390 describe the preparation of such microporous expanded polytetrafluoroethylene membranes and are incorporated herein by reference.

The continuous water vapour permeable polymer layer used in the invention is a hydrophilic polymer. The hydrophilic layer selectively transports water by diffusion but does not support pressure-driven liquid or air flow. Therefore moisture, i.e. water vapour, is transported but the continuous layer of the polymer precludes the passage of such things as air-borne particles, microorganisms, oils or other contaminants. This characteristic imparts to the textile including the polymer layer and in turn to articles made from it, such as socks or gloves, good contamination control characteristics by functioning as a barrier to contaminants of all sizes. Furthermore the water vapour transmitting characteristics of the material allow for comfort characteristics to the wearer.

The continuous water vapour permeable polymer layer is typically of a thickness of between 5 $\mu$m and 50 $\mu$m, preferably between about 10 $\mu$m and 25 $\mu$m. This thickness has been found to be a good practical balance to yield satisfactory durability, continuity and rate of water vapour transmission.

Although not limited to them, the continuous water-vapour permeable polymers most useful herein are those of the polyurethane family, the silicone family, the co-polyetherester family or the co-polyetherester amide family. Suitable co-polyetherester hydrophilic composition may be found in the teachings of U.S. Pat. No. 4,493,870 (Vrouenraets) and U.S. Pat. No. 4,725,481 (Ostapachenko). Suitable hydrophilic compositions are described in U.S. Pat. No. 4,2340,838 (Foy et al.). Suitable polyurethanes maybe found in U.S. Pat. No. 4,194,041 (Gore). A preferred class of continuous, water vapour permeable polymers are polyurethane, especially those containing oxyethylene units, such as described in U.S. Pat. No. 4,532,316 (Henn). Typically these materials comprise a composition having a high concentration of oxyethylene units to impart hydrophilicity to the polymer. The concentration of oxyethylene units is typically greater than 45% by weight of the base polymer, preferably greater than 60%, most preferably greater than 70%. The functional layer of this invention can be prepared according to the teachings of U.S. Pat. No. 5,026,591 (Henn et al.).

The textile laminates 300, 310 used in the current invention are preferably provided with a backer fabric 330. The backer fabric 330 may be either woven, non-woven or knitted and may be made from a wide variety of materials such as polyester, polyamide (Nylon), polyolefins and the like. The backer fabric 330 is laminated to the first side of the functional layer 320 by a standard lamination process. The three layer laminate 310 is furthermore provided with an outer fabric 340 which may be either woven, non-woven or knitted and may be made from a wide variety of materials such as polyester, polyamide (Nylon), polyolefins and the like. The outer fabric 340 is laminated to the second side of the functional layer 320 by a standard lamination process.

It will be observed that the first textile piece 20 and the second textile piece 30 are essentially mirror images of each other, except that the second textile piece 30 has a piece of material in the shape of a triangle 150 having a triangle first side 152 and a triangle second side 154 which is removed from the lower half of the second textile piece 30. This leaves an approximately 1 cm wide strip 160 of textile laminate on the right hand side (as depicted) of the second textile piece 30. On the left hand side (as depicted) of the second textile piece 30, i.e. corresponding to the triangle second side 154, the bottom of the triangular-shaped space 150 is at a second position 140 approximately 1 cm from the ulnar-side cuff outer edge 85. Other patterns are also possible, e.g. petal-shaped or by shifting the tip of the triangle 150 more towards the middle finger.

The first textile piece 20 and the second textile piece 30 are prepared from a supply roll of the two layer laminate 300 or the three layer laminate 310. The two layer laminate 300 or the three layer laminate 310 are passed to a die cutter which cuts the laminate into the shape required as shown in FIGS. 3*a* and 3*b*. Alternatively, the two layer laminate 300 or the three layer laminate 310 can be prepared by hand cutting to form the pattern of FIGS. 3*a* and 3*b*.

The first textile piece 20 is joined to the second textile piece 30 at their peripheral edges. A first seam 1 10 between the first textile piece 20 and the second textile piece 30 is formed which runs along the ulnar-side cuff outer edge 85 of the cuff portion 80 to the finger ulnar side 46 of the finger portion 40, from there along the periphery of the finger portion 40 to the finger radial side 44 of the finger portion 40 down to the crotch 100, along the periphery of the thumb portion 50 and then diagonally across the palm portion 70 of the glove insert 10 as a first seam 110 to the first position 130 adjacent to the hand entry 90 and at a distance a from the seam on the ulnar side cuff outer edge 85. This distance a is approximately 2 cm.

A number of techniques are known for forming the seam between the first textile piece 20 to the second textile piece 30. In one embodiment of the invention, the first textile piece 20 is stitched at its peripheral edge to the second textile piece 30. Seam tape, such as GORE-SEAM® seam sealing tape is subsequently applied to the stitch seam in order to ensure that the seam is waterproof. Alternatively, the techniques disclosed in European Patent EP-B-0 345 730 (Kleis) assigned to W.L. Gore & Associates can be used. In this embodiment, an adhesive is applied to the periphery of the first textile piece 20 and/or the second textile piece 30. After curing the adhesive a waterproof seam is formed. Adhesives used for forming the waterproof seam can be, for example, polyurethane, acrylic or silicone adhesives applied in a liquid or pasty form or as an adhesive film. In the preferred embodiment of the invention reactive polyurethane adhesives, such as IPATHERM available from Fuller in Munich, Germany, are used.

After joining the first textile piece 20 to the second textile piece 30, the space formed by the triangular shape 150 in the palm of the glove insert 10 is removed by joining the triangle first side 152 to the triangle second side 154 by a second seam 120 as is seen in FIG. 2. The second seam 120 runs from a position approximately 1 cm distant from the crotch 100 diagonally across the palm portion 70 of the glove insert to a second position 140 adjacent to the hand entry 90. The second seam 120 is substantially parallel to the first seam 110. The second seam can be formed by sewing and taping or by using an adhesive as described above.

Figure 4:
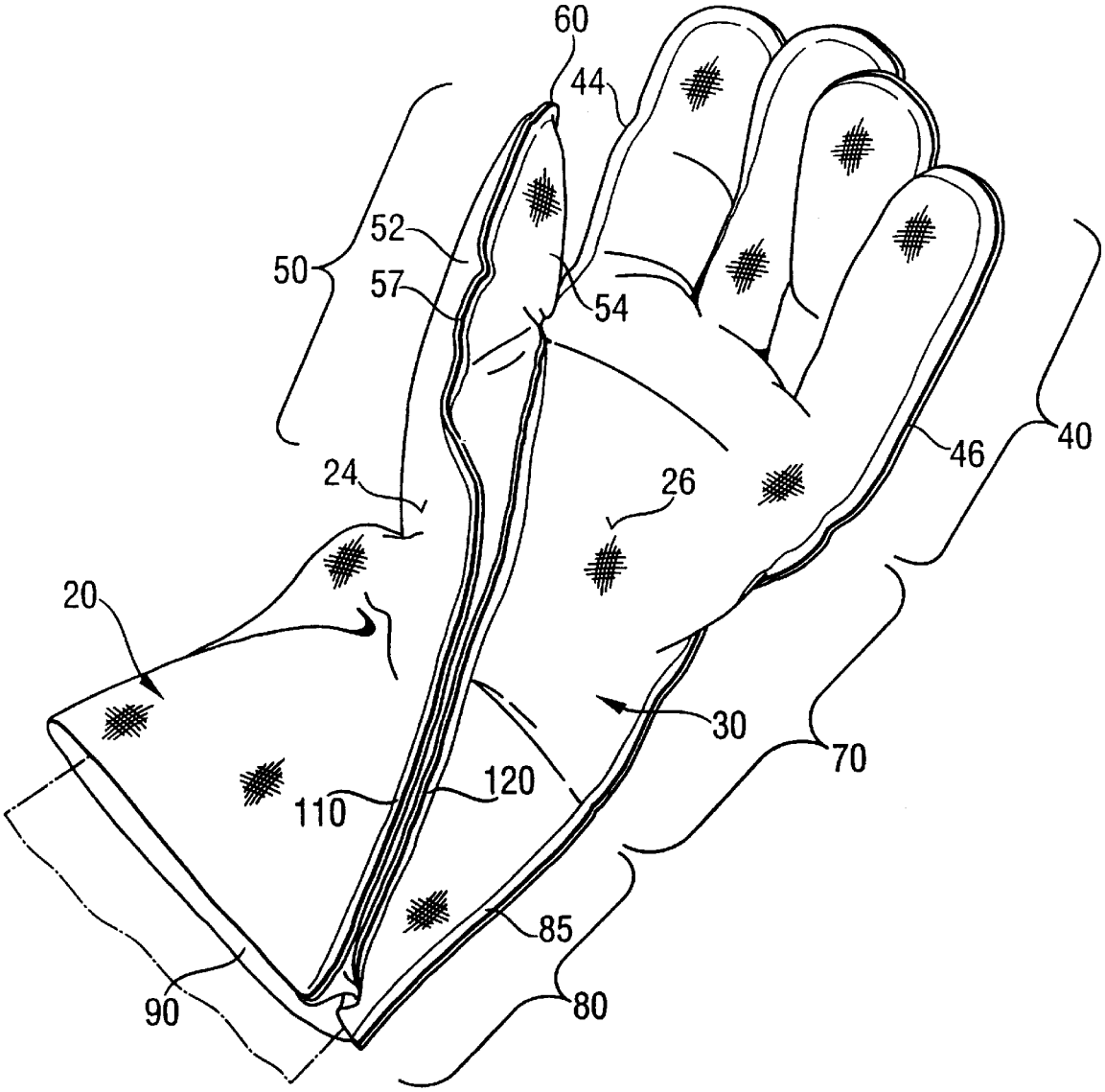
FIG. 4 shows a perspective view of the glove insert of the invention
Figure 5:
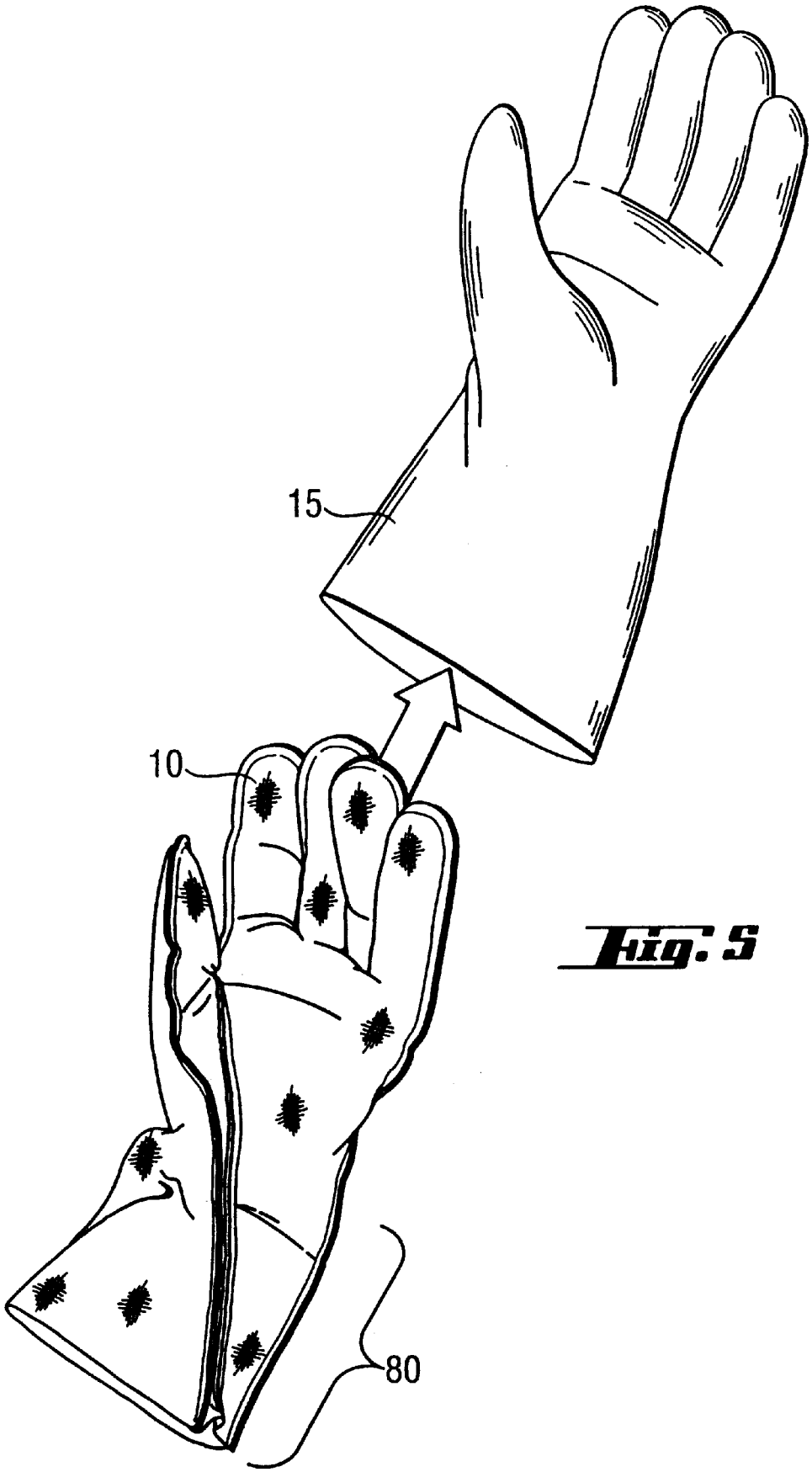
FIG. 5 shows a glove insert inserted into an outer shell.

FIG. 4 shows a perspective view of the glove insert 10 manufactured according to the above principles. It will be seen that the thumb portion 50 of the glove insert is in a different plane than the finger portion 40 and thus has a different degree of freedom of movement. This makes the glove insert substantially more comfortable to wear than the prior art glove inserts.

The manufactured glove insert 10 can be attached to the outer shell 15 of a glove either by sewing at the cuff portion 80, by adhesive or by providing tabs on the outside of the glove insert which can be stitched to the inside of the outer shell 14.

Figure 7A:
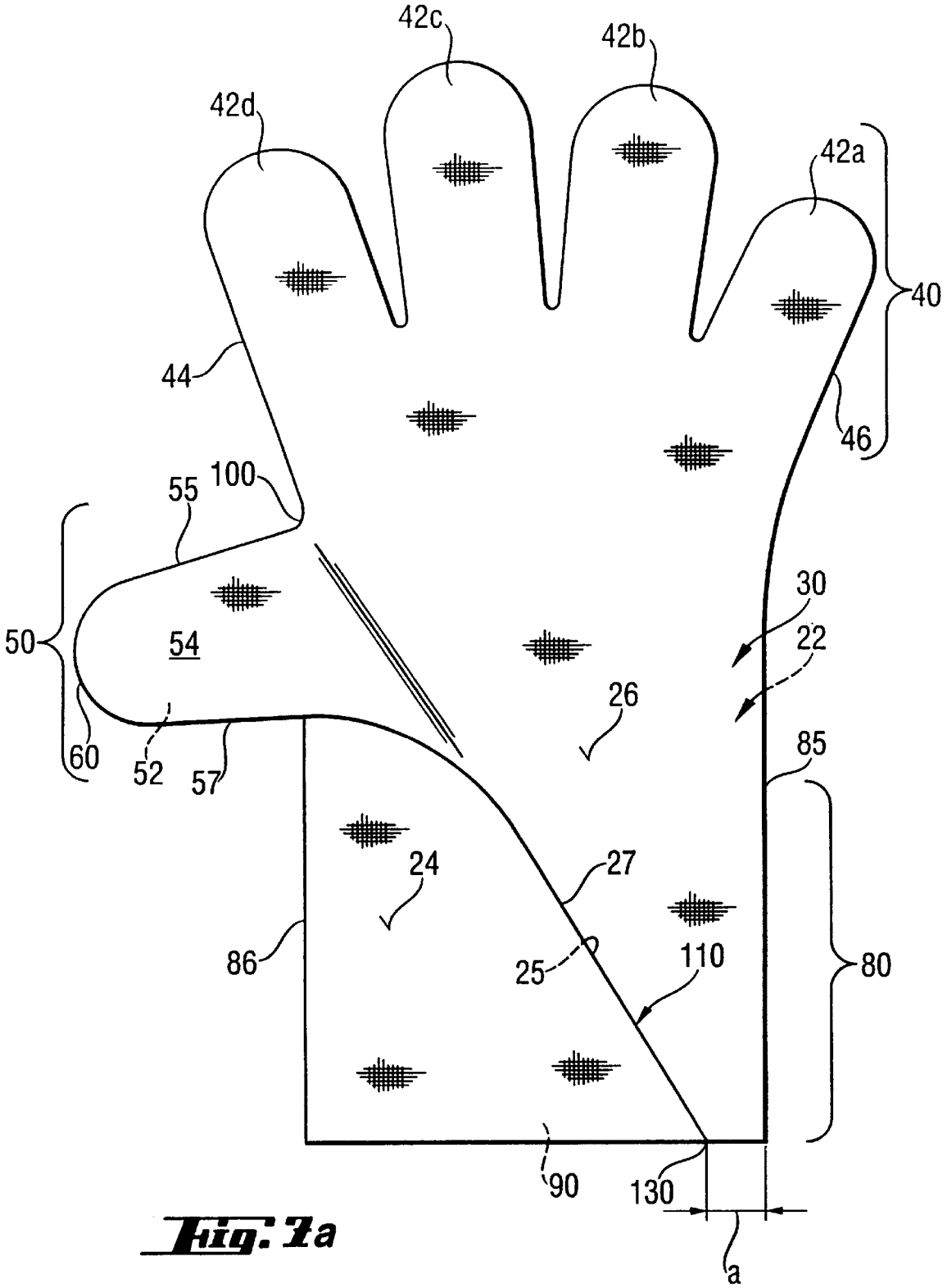
FIG. 7*a* shows a first front (palm) view of a second embodiment of the glove insert of the invention.
Figure 7B:
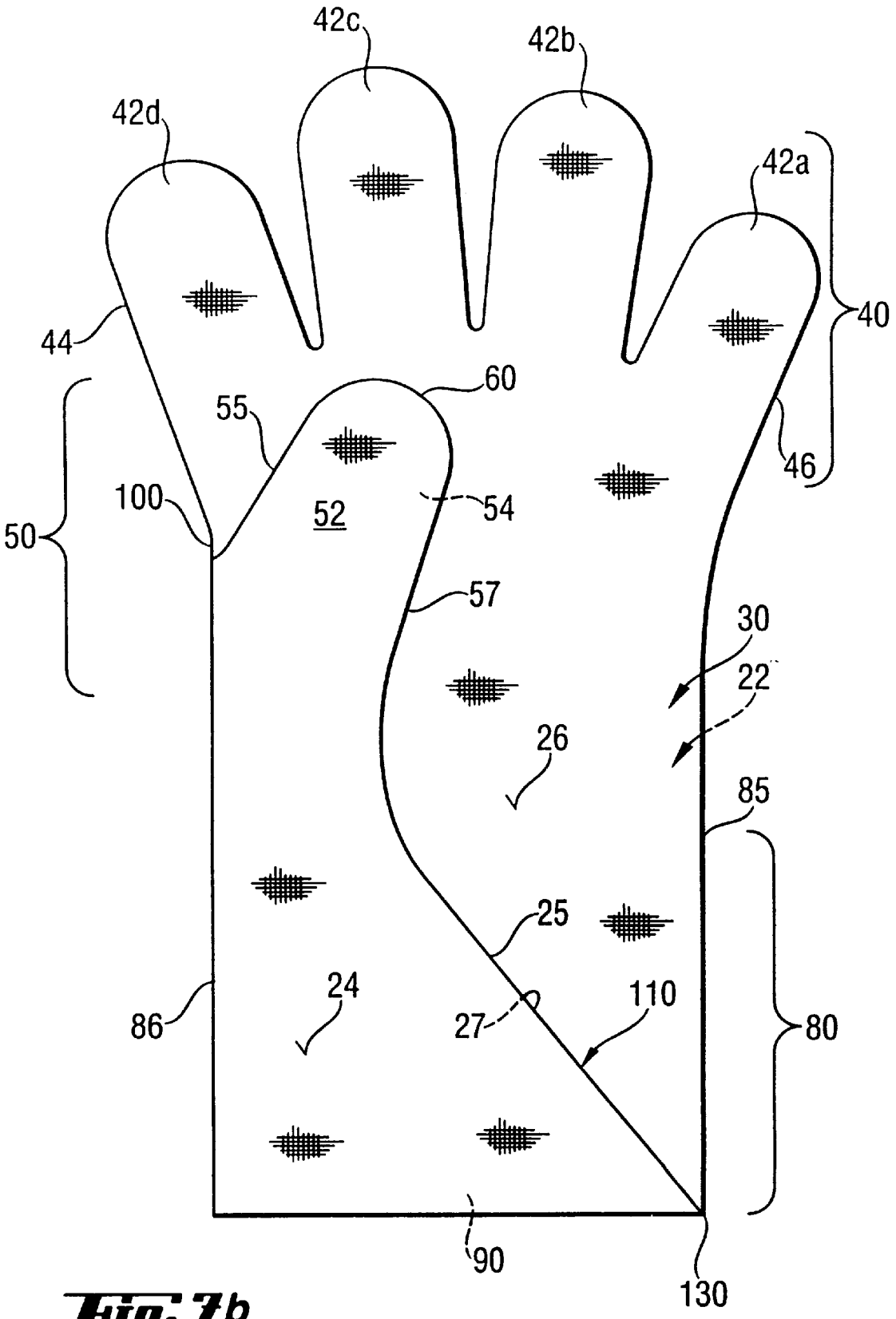
FIG. 7*b* shows a second front (palm) view of a second embodiment of the glove insert of the invention.

FIGS. 7*a* and 7*b* show a back view and a front view respectively of a further embodiment of the glove insert 10 of the invention. In these Figs. the same reference signs are used to denote similar features as in the other figures. As described above the glove insert 10 is formed from the first textile piece 20 and the second textile piece 30. The first textile piece 20 forms the dorsal or back side 22 of the glove insert 10 and a first palm portion 24 of the palm or front side of the glove insert 10 as well as a first thumb side 52 of the thumb portion 50. The first palm portion 24 has an edge 25. The second textile piece 30 forms the front side of the finger portion 40, a second thumb side 54 of the thumb portion 50 as well as a second palm portion 26 of the front side of the glove insert 10. The second palm portion 26 has an edge 27.

The thumb portion 50 of the glove insert 10 has a thumb tip 60, a finger-side thumb outer edge 55 on the side of the thumb portion adjacent to the finger portion and a radial-side thumb outer edge 57 on the radial side of the glove insert 10. The thumb portion 50 is formed from the first thumb side 52 of the first textile piece 20 and the second thumb side 54 of the second textile piece 30.

The finger portion 40 has a finger radial side 44 on the radial side of the glove insert 10 and a finger ulnar side 46 on the ulnar side of the glove insert 10. A crotch 100 is situated between the thumb portion 50 and the finger portion 40. The crotch 100 is thus situated at the position at which the finger radial side 44 meets the finger-side thumb outer edge 55.

The cuff portion 80 of the glove insert 10 is adjacent to the hand entry 90 of the glove insert 10 and has an ulnar-side cuff outer edge 85 on the ulnar side of the glove insert 10.

Figure 8A:
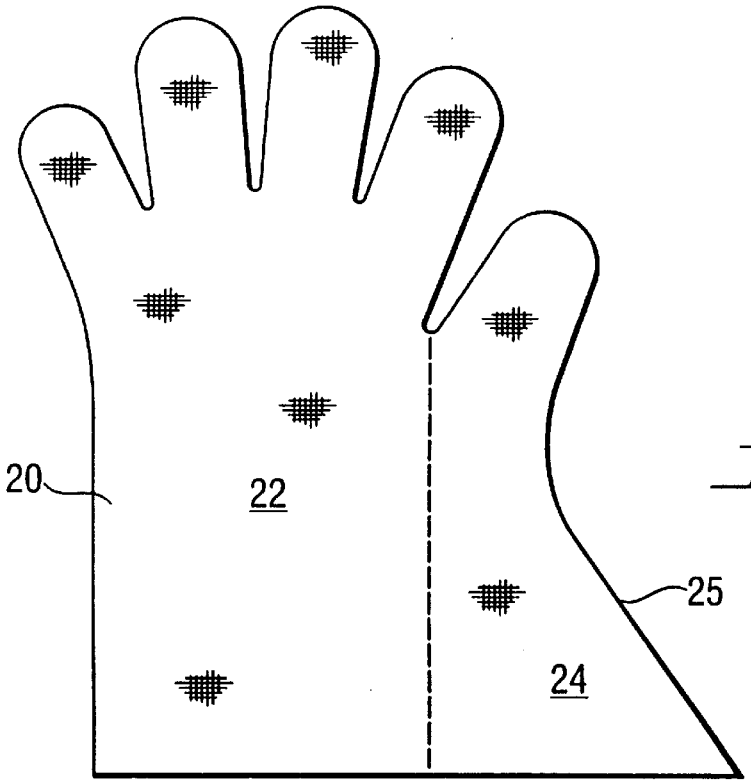
FIG. 8*a* shows the textile piece forming the dorsal side of the second embodiment of the glove insert.
Figure 8B:
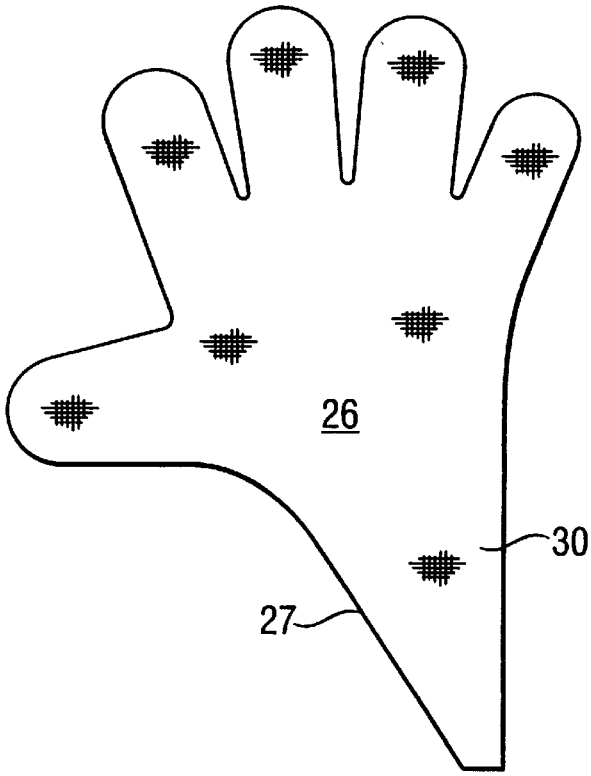
FIG. 8*b* shows the textile piece forming the palm side of the second embodiment of the glove insert.

FIGS. 8*a* and 8*b* show the pattern of the first textile piece 20 and the second textile piece 30 respectively prior to joining the two textile pieces 20, 30 together. The textile pieces are preferably made from the textile laminates described above and depicted in FIGS. 6*a* and 6*b*. It will observed that the finger portion 40 and thumb portion 50 of the first textile piece 20 and the second textile piece 30 are essentially mirror images of each other. The first textile piece 20 has in its lower half sufficient material to form the back side 22 of the glove insert and sufficient material to form the first palm portion 24. The second textile piece 30 has in its lower half only that material required to form the second palm portion 26. The edge 25 of the first palm portion 24 of the first textile piece 20 is cut such that it matches up with the edge 27 of the second palm portion 26 of the second textile piece 30.

The first textile piece 20 and the second textile piece 30 are prepared from a supply roll of the two layer laminate 300 or the three layer laminate 310. The two layer laminate 300 or the three layer laminate 310 are passed to a die cutter which cuts the laminate into the shape required as shown in FIGS. 8*a* and 8*b*. Alternatively, the two layer laminate 300 or the three layer laminate 310 can be prepared by hand cutting to form the pattern of FIGS. 8*a* and 8*b*.

The first textile piece 20 is joined to the second textile piece 30 at their peripheral edges. A seam between the first textile piece 20 and the second textile piece 30 is formed which runs along the ulnar-side cuff outer edge 85 of the cuff portion 80 to the finger ulnar side 46 of the finger portion 40, from there along the periphery of the finger portion 40 to the finger radial side 44 of the finger portion 40 down to the crotch 100, along the periphery of the thumb portion 50 and then diagonally across the palm portion 70 along the edges 25, 27 of the glove insert 10 to the first position 130 adjacent to the hand entry 90 and at a distance a from the seam 110 on the ulnar side cuff outer edge 85. This distance a is approximately 2 cm. As described above, a number of techniques are known for forming the seam 110 between the first textile piece 20 to the second textile piece 30.

Figure 9A:
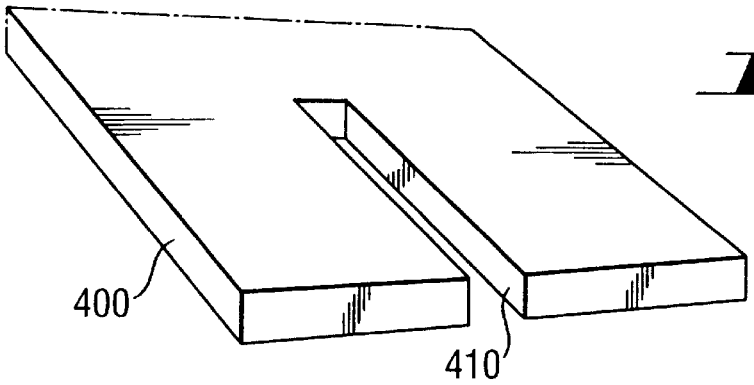
FIG. 9 show a manufacturing method for the second embodiment of the glove insert.
Figure 9B:
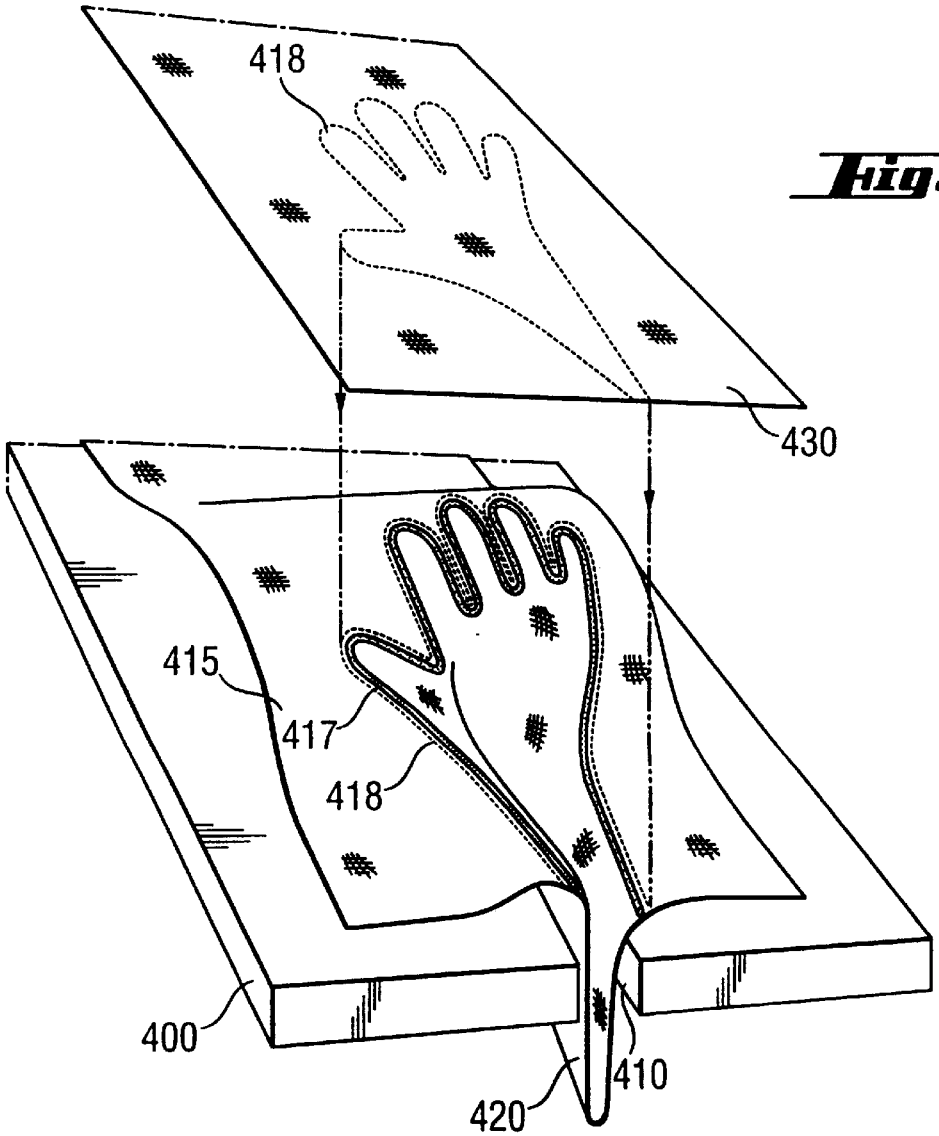

A method for manufacturing this second embodiment of the invention is illustrated in FIGS. 9*a* and 9*b*. This method uses a ground plate 400 in which a slit 410 is cut (see FIG. 9*a*). A first piece of laminate from a supply roll is placed on the ground plate 400 and a part of the laminate 310 which will ultimately form the cuff portion 80 of the first textile piece 20 is pulled through the slit 410 to form a fold 420. Using the techniques disclosed in the European Patent EP-B-0 345 730 (Kleis) a plotter is used to place a bead of adhesive in a line 417 on the surface of the laminate 415 in the pattern of the glove insert which will after die-cutting form the periphery of the first textile piece 20. A second piece of laminate 430 is placed on top of the first laminate piece 415 and pressed down along the line 417 on which the bead of adhesive is placed such that the seam formed is waterproof after the adhesive has been cured (see FIG. 9*b*). A die cutter is then used to cut out the glove insert 10 thus formed along the line 418.

The seams of the manufactured glove insert 10 were tested using the suture test in which water pressure was applied to one side of the seam at 0.21 bar for two minutes. No leaks were seen emerging from the other side of the seam. Using the Gore Whole Glove Leak Tester an air pressure of 0.14 bar was applied inside the glove insert 10 and no air bubbles were observed emerging from the glove insert 10.

Measurements of WVTR the textile laminates used to make the glove inserts were carried out using the tests described above and the following results obtained.

| Source | Structure | No. of Laminate Layer | WVTR/m$^2$ · 24 hr |
|---|---|---|---|
| Gore, Feldkirchen, Germany, | Non-Woven | 3 | 9600 |
| Japan GORE-TEX Inc. | Non-Woven | 3 | 8000 |
| Gore Elk Creek, US | Direct Grip | 3 | 5000 |
| Gore, Feldkirchen, Germany | Direct Grip | 3 | 6400 |

The non-woven laminate has a non woven fabric made from polyamide (Japan Gore-Tex Inc.) or polypropylene (Gore, Feldkirchen) laminated onto both sides of an ePTFE functional layer. The US Direct Grip laminate has a polyamide non-woven textile laminated onto one side of an ePTFE functional layer and a polyester brushed tricot knit laminated onto the other side. The Feldkrichen Direct Grip laminate has a polypropylene non-woven textile laminated onto one side of an ePTFE functional layer and a polyester brushed tricot knit laminated onto the other side. Th given textile layers are not limiting of the invention. For example, bicomponent yarns could be used. Additionally for fire-fighting applications PBI yarn can be used. The yarns may be knitted, woven or non-woven.

What is claimed is:

1. Glove insert being made of a first textile piece and second textile piece and having a finger portion having a finger radial side and a finger ulnar side, a thumb portion, with a thumb tip and a finger-side thumb outer edge, a palm portion, a cuff portion with an ulnar side cuff outer edge on the ulnar side of the glove insert and a radial side cuff outer edge on the radial side of the glove insert a hand entry through which the wearer slips a hand, and a crotch being between the finger radial side and the thumb portion wherein the finger radial side is continguous with the finger ulnar side, cuff ulnar-side outer edge and the finger-side thumb outer edge; and wherein the first textile piece is joined to the second textile piece solely by a first seam situated on the cuff ulnar side outer edge, the finger radial side outer edge and the finger-side thumb outer edge and running from the thumb tip across the palm portion and cuff portion towards the cuff unlar side outer edge.

2. Glove insert according to claim 1 wherein the first textile piece furthermore includes a second seam running from the crotch to a second position in the cuff portion at the hand entry.

3. Glove insert according to claim 2 wherein the second seam is waterproof.

4. Glove insert according to claim 3 wherein the second seam withstands a water-entry pressure of at least 0.07 bar.

5. Glove insert according to claim 2 wherein the second seam is formed by an adhesive bond.

6. Glove insert according to claim 2 wherein the second seam is formed by welding.

7. Glove insert according to claim 2 wherein the second seam is formed by sewing or welding and is sealed by a seam sealing tape.

8. Glove insert according to claim 1 wherein the first seam and the second seam are substantially parallel to each other.

9. Glove insert according to claim 1 wherein the second seam runs diagonally across the palm portion and the cuff portion.

10. Glove insert according to claim 1 wherein the first seam is waterproof.

11. Glove insert according to claim 10 wherein the first seam withstands a water-entry pressure of at least 0.07 bar.

12. Glove insert according to claim 11 wherein the first seam withstands a water-entry pressure of at least 2.1 bar.

13. Glove insert according to claim 11 wherein the second seam withstands a water-entry pressure of at least 2.1 bar.

14. Glove insert according to claim 1 wherein the first seam is formed by an adhesive bond.

15. Glove insert according to claim 1 wherein the first seam is formed by welding.

16. Glove insert according to claim 1 wherein the first seam is formed by sewing or welding and is sealed by a seam sealing tape.

17. Glove insert according to claim 1 wherein the glove insert is waterproof.

18. Glove insert according to claim 17 wherein the glove insert withstands a water-entry pressure of at least 0.07 bar.

19. Glove insert according to claim 17 wherein the glove insert withstands a water-entry pressure of at least 2.1 bar.

20. Glove insert according to claim 1 wherein the first textile piece and the second textile piece are water-vapor permeable.

21. Glove insert according to claim 20 wherein the resistance to moisture vapor transmission (Ret) of the first textile piece and the second textile piece is less than 150 $m^2 \cdot Pa/W$.

22. Glove insert according to claim 21 wherein the resistance to moisture vapor transmission (Ret) of the first textile piece and the second textile piece is less than 20 $m^2 \cdot Pa/W$.

23. Glove insert according to claim 1 wherein the first textile piece and the second textile piece are formed of a textile laminate including a functional layer.

24. Glove insert according to claim 23 wherein the functional layer is selected from the group of materials consisting of polyesters, polyamide, polyolefins including polyethylene and polypropylene, polyvinylchloride, polyketones, polysulfones, polycarbonates, fluoropolymers including polytetrafluoroethylene (PTFE), polyacrylates, polyurethanes, copolyetheresters, copolyetheramides.

25. Glove insert according to claim 24 wherein the functional layer is expanded PTFE.

26. Glove insert according to claim 23 wherein the textile laminate includes a hand-side textile layer.

27. Glove insert according to claim 23 wherein the textile laminate includes an outer textile layer.

28. Glove insert according to claim 1 wherein the finger portion comprises four individual finger elements.

29. Glove insert according to claim 1 wherein the finger portion comprises two individual finger elements.

30. Glove made of an outer shell and a glove insert according to one of claims 1 to 29.

* * * * *